United States Patent [19]

Wong

[11] 4,159,098

[45] Jun. 26, 1979

[54] FORM FOR CASTING STEPPED OPENINGS

[75] Inventor: John B. Wong, Oakland, Calif.

[73] Assignee: Calmar International, Inc., Oakland, Calif.

[21] Appl. No.: 855,819

[22] Filed: Nov. 30, 1977

[51] Int. Cl.[2] ..... B28B 7/30

[52] U.S. Cl. ..... 249/61; 249/39; 249/94; 249/184; 425/DIG. 33

[58] Field of Search ..... 249/39, 184, 186, 91, 249/93, 94, 96, 61; 425/3, DIG. 33; 52/DIG. 4

[56] References Cited

U.S. PATENT DOCUMENTS

| | | | |
|---|---|---|---|
| 916,705 | 3/1909 | Hill et al. | 249/184 |
| 1,247,784 | 11/1917 | Baumgardner | 249/184 |
| 2,643,418 | 6/1953 | Auldridge | 425/DIG. 33 |
| 2,770,013 | 11/1956 | Crooker | 425/DIG. 33 |
| 3,439,732 | 4/1969 | Andreoli | 249/91 |
| 3,439,894 | 4/1969 | Haider | 249/39 |

*Primary Examiner*—John McQuade
*Attorney, Agent, or Firm*—Phillips, Moore, Weissenberger, Lempio & Majestic

[57] ABSTRACT

A form for casting stepped openings in concrete walls, the form having four elongated form members arranged in a rectangle, each form member having outer casting surfaces thereon to form one side of the opening. A corner piece at each corner of the form engages the ends of the form members thereat and completes the casting surfaces thereof, the corner pieces and form members being shaped to allow translatory movement of the form members away from the sides of the opening cast thereby so that the form members may be removed from the opening. Selected of the form members have recesses in the casting surface thereof for reception of hardware to be cast into the wall, the hardware being held in the recesses by magnets.

8 Claims, 8 Drawing Figures

FORM FOR CASTING STEPPED OPENINGS

BACKGROUND OF THE INVENTION

This invention relates to forms for use in casting of concrete walls and more particularly to forms used in the casting of stepped openings in walls.

It is a common practice in the construction of concrete buildings to build concrete houses to cast the walls or wall sections as slabs in horizontal forms. After the concrete has cured, the wall is raised to vertical position, moved into position with other walls of the structure and joined thereto. It is also common practice to cast the wall sections with suitably located door and window openings.

In many instances, the specifications for a wall section will include one or more window or door openings having a stepped configuration to provide a shoulder against which a door or window is to close, and, in many instances, the specifications are such that when the wall is cast in its horizontal form, the shoulder of the opening is facing downwardly. In such case the dimensions of the opening at the upper surface of the poured slab are less than that at the bottom of the slab.

It is a relatively simple matter to design a form having a shape which will give the desired stepped configuration to the opening. However, the construction of such forms represents a significant cost factor. Since the form is larger at the bottom it cannot be removed from the cast slab simply by pulling it out. Removal while the slab is still in place is usually accompanied by partial or complete destruction of the form. As a result, a new form is usually required for each opening to be cast. This increases the cost and increases the chances that the form will not have the precise dimensions desired.

The forms can be removed through the larger side of the opening after the slab has cured and has been raised from the casting pad. However, this necessitates a long delay before any possible reuse of the form.

Window and door openings in the finished wall must also be provided with appropriate hardware so that windows and doors can be hung in the opening. Usually such hardware is installed after the walls are in place, which is a relatively expensive procedure since it requires that holes be drilled into the concrete or that nail guns be used. There have been attempts to secure the hardware to the forms so that the hardware will be cast as the concrete is poured. This has not been too satisfactory since it is difficult and time-consuming to attach the hardware to the form. Also, the hardware must be very carefully positioned on the form so that the cast-in-place hardware will properly mate with the hardware on the doors and windows to be later installed.

It is the principal object of the present invention to provide a form for a stepped opening in a cast concrete wall which can be easily removed after the initial set of concrete and can be promptly reused for forming another opening.

It is a further object of the present invention to provide a form for openings in cast concrete walls which enables hardware to be easily secured to the form and precisely positioned thereon so that such hardware can be cast into the opening as the concrete is poured.

SUMMARY OF THE INVENTION

The form of the present invention comprises a separate form member for each side of the opening, each form member having casting surfaces for forming the desired stepped configuration of the opening. The maximum length of each form member is less than the smallest length of the opening it is forming so that the form member can be removed therefrom. Special corner pieces are provided at each corner of the form to complete the casting surfaces and to permit translatory movement of the form members out from under the downwardly facing shoulder cast into the opening so that the form members can be removed.

The form members of the present invention are also provided with means for precisely located hardware to be cast into the opening, and are provided with magnets for holding hardware to the form as the concrete is poured.

Other objects and advantages will become apparent in the course of the following detailed description.

BRIEF DESCRIPTION OF THE DRAWINGS

In the drawings, forming a part of this application, and in which like parts are designated by like reference numerals throughout the same.

DESCRIPTION OF THE PREFERRED EMBODIMENT

Figure 1:
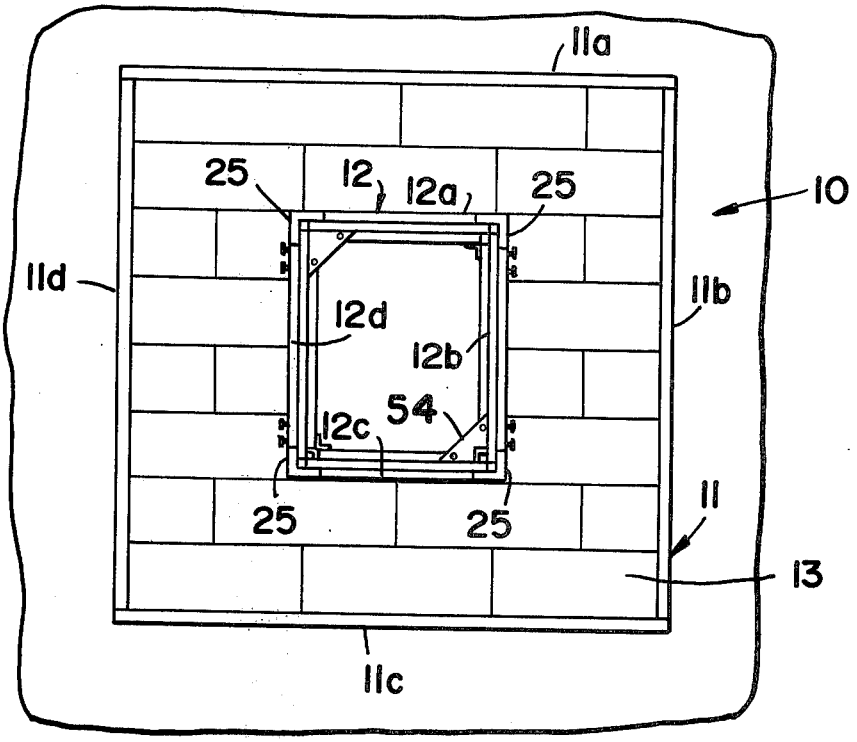
FIG. 1 is a plan view of a casting pad with a wall and window form assembled thereon, the window form being constructed in accordance with the invention.

Referring to FIG. 1, such figure shows a horizontally disposed casting pad 10, with an outer form 11 and a window form 12 assembled thereon so that a concrete wall can be cast. The outer form 11, used to define the perimeter of the wall, is made of members 11*a*, 11*b*, 11*c* and 11*d*, each having an appropriate length so that the cast wall will have a desired length and height. The outer form members extend upwardly from the casting pad 10 a distance equal to the desired thickness of the wall. A conventional patterned sheet mold 13 may be laid on the casting pad 10 to form a complementary pattern or design on the face of the wall which contacts such mold. For example, the mold 13 as illustrated herein will provide a simulated brick appearance to the finished wall. The window form 12 likewise has overall dimensions to give the desired size window opening, and extends upwardly from the casting pad a distance equal to the desired thickness of the wall.

Figure 2:
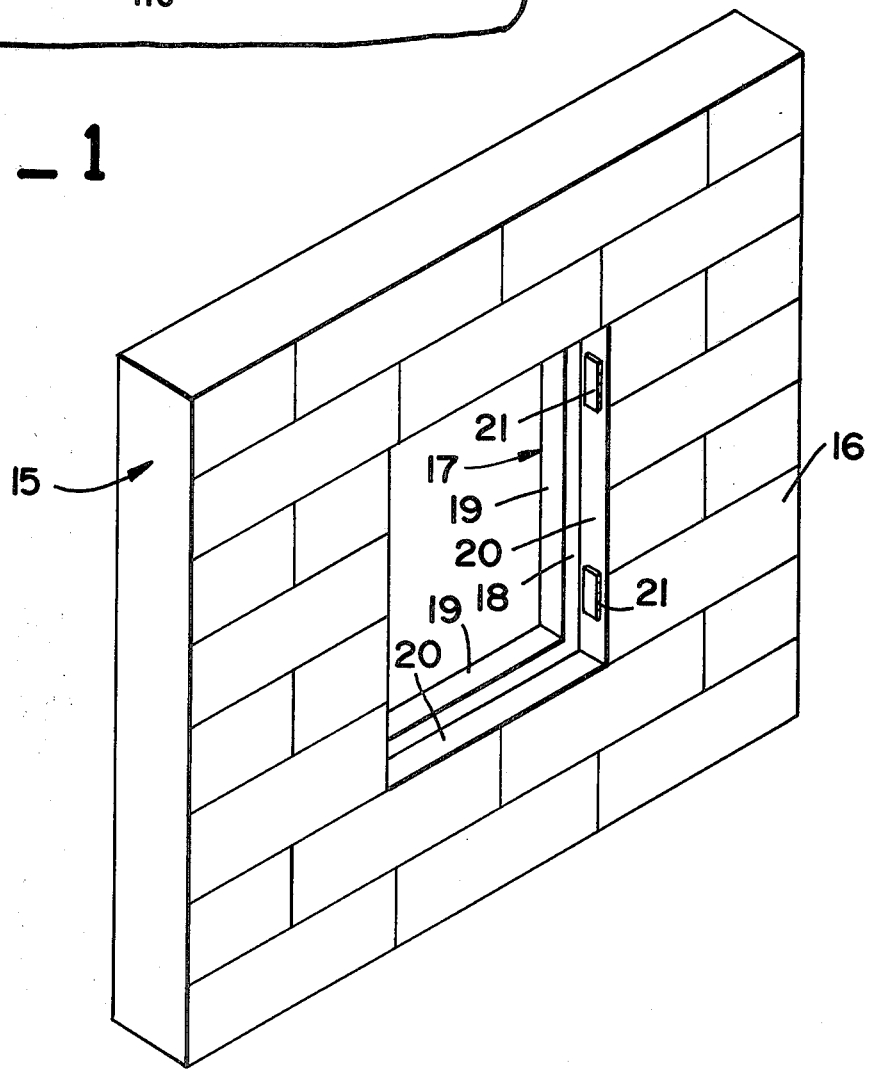
FIG. 2 is a perspective view of a concrete wall cast from the forms of FIG. 1.

FIG. 2 illustrates a finished wall 15 which has been cast using the form of FIG. 1, the forms having been removed and the wall raised to a vertical position. Such wall has its outer surface 16 with the brick pattern of mold 13 imparted to it. The window form 12 has formed a stepped window opening 17 in the wall, such window opening having an outwardly facing shoulder 18 generally parallel to the wall surface 16 and extending around the periphery of the window. The window opening also has surfaces 19 and 20 generally perpendicular to the wall, surfaces 19 extending from shoulder 18 to the inner surface of the wall and surface 20 extending from shoulder 18 to the outer wall surface 16. If desired, the window form 12 may be suitably shaped so that one or more of the surfaces 20 will slope outwardly frm the shoulder 18. For example, it is common practice to slope the lowermost surface 20 downwardly for rain water drainage and to facilitate opening and closing of a window installed in opening 17. Window opening 17 also has window hinges 21 cast in place at desired locations in surface 20 so that casement windows (not shown) can be mounted thereon.

The window form 12 comprises four elongated form members **12*a*, 12*b*, 12*c* and 12*d*, and a corner piece 25** disposed at each corner of the form, the shape of these form members and corner pieces being best illustrated in FIGS. 3–7.

Form sections **12*a*–*d* each have a central member 26, which is generally rectangular in cross-section, such member having an outwardly facing casting surface 27 thereon extending along the upper length of the central member from one end to the other. Such casting surface 27 will form the surface 20 in one side of the window opening 17. Each form section member also includes a second member 28 extending along the central member 26. Preferably the ends 29 of the second member 28 terminate short of the ends 30 of the central member 26 to expose an outwardly facing surface 31 on the lower part of the central member 26 at each end thereof. Member 28 has outwardly and downwardly extending casting surfaces 32 and 33 which are utilized to form the surfaces 19 and 20** respectively of the window opening.

An inner member 35 is secured to central member 26 for reinforcement thereof, and extends substantially the full length thereof. Inner member 35 terminates short of the end face 30 of central member 26 so that the distance from the end face 36 of inner member 35 to the end face 30 of the central member 26 is at least equal to the thickness of the adjacent inner member 35. The inner member 35 has a screw 37 near each end thereof. When the form has been assembled, a corner bracket 38, having vertical slots 39, can be slipped over the shanks of screws 37, the screws then being tightened against the bracket to hold the form members securely together.

Figures 3, 4, 5, 6, 7, 8:
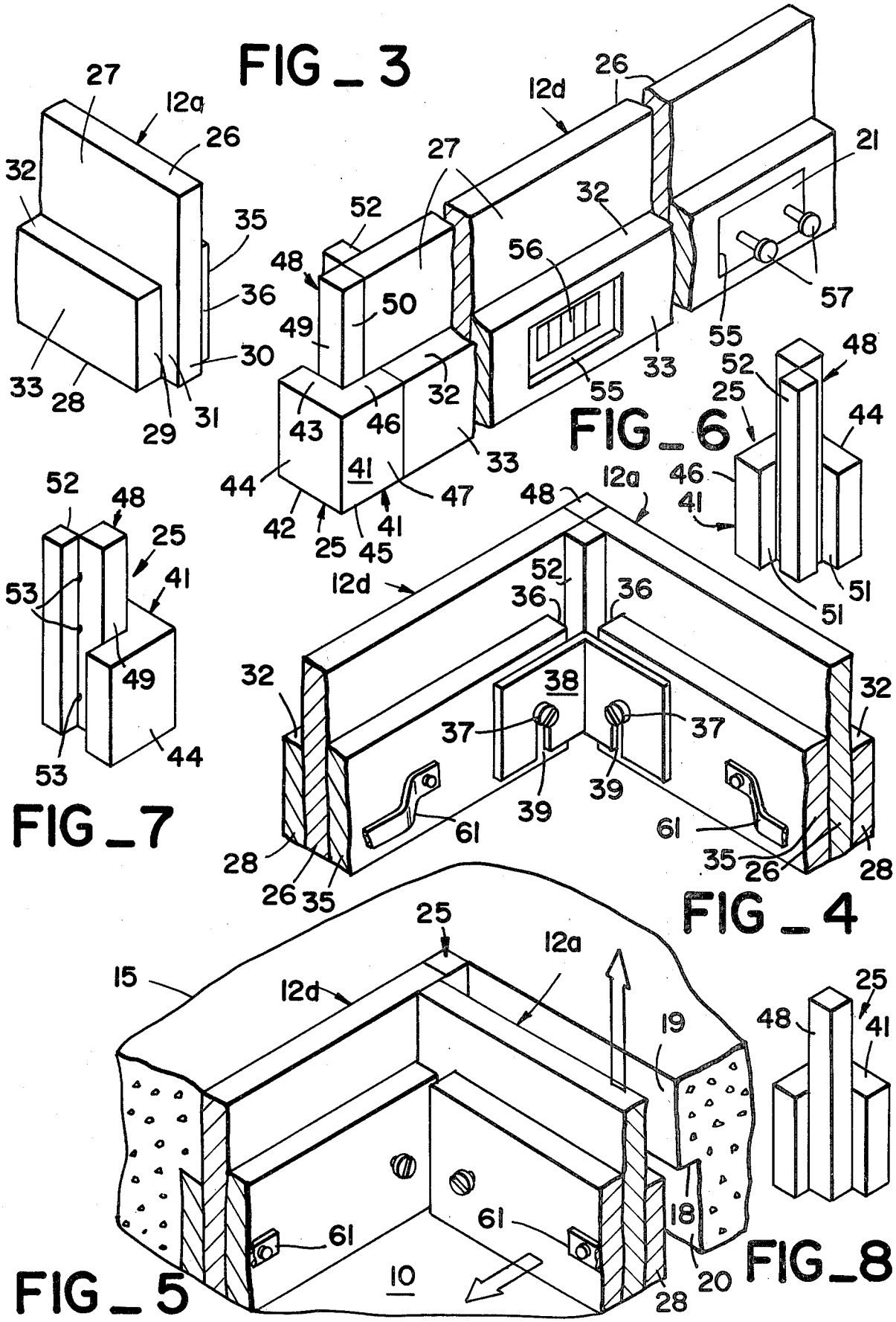
FIG. 3 is a perspective view, partially exploded of the window form of FIG. 1, looking towards one corner thereof from outside of the form.
FIG. 4 is a perspective view of the window form of FIG. 1, looking towards one corner thereof from the inside of the form.
FIG. 5 is a perspective view similar to FIG. 4, illustrating the manner in which the form is removed from the cast concrete.
FIGS. 6 and 7 are perspective views, from different angles, of one of the corner pieces of the window form of FIG. 1.
FIG. 8 is a modification of a corner piece usable in the present invention.

The corner pieces 25 each comprise a block 41 having an L shape in horizontal cross-section. As shown in FIG. 3, leg 42 of the block is abuttable against the end 29 of the outer member 28 of form section **12*a*, leg 42 having outwardly and downwardly extending casting surfaces 43 and 44 which are coplanar with casting surfaces 32 and 33 of form section 12*a* to form an extension thereof when the form is assembled. Leg 45 of block 41 is likewise abuttable against the end of member 28 of form section 12*d*, leg 45 having outwardly and downwardly extending casting surfaces 46 and 47 coplanar with casting surfaces 32 and 33 of form section 12*d***.

Each corner piece further comprises a post 48 which extends upwardly from the inner junction of the legs of block 41. Post 48 has adjacent sides 49 and 50 which form outwardly facing casting surfaces coplanar with the casting surfaces 27 on form sections **12*a* and 12*d* respectively when the form is assembled and the post is abutted against the ends 30** of the form sections.

Post 48 is preferably rectangular in horizontal cross-section, and the width of side 49 is at least as great as the thickness of central member 26 of form section **12*d* so that form section 12*a* can be removed after casting. Likewise, the width of side 50 of the post is at least as great as the thickness of central member 26 of form section 12*a* so that form section 12*d* may be removed, after casting, while form section 12*a*** is still in place.

The legs of block 41 extend laterally beyond post 48 to provide bearing surfaces 51 (FIG. 6) which will engage surfaces 31 on the form sections for alignment purposes, when the form is assembled, the width of surfaces 51 and 31 being equal to each other.

The corner pieces 25 are preferably molded from plastic and include a vertically extending retainer post 52 parallel to post 48, retainer post 52 being secured, by readily breakable bridge member 53 formed during the molding, to post 48 at the vertical corner of post 48 diagonally across from the junction of the sides 49 and 50 of the post 48.

In use, the form sections **12*a*–12*d* are assembled together on the casting pad 10 as illustrated in FIGS. 3 and 4, with a corner piece 25 at each corner of the form and the screws 37 are tightened against brackets 38 to hold the form securely together. The retainer posts 52 bear against the inner surfaces of the central members 26 and thus hold the corner pieces in place. If desired, a right-angle corner plate 54 (FIG. 1) could be used in place of bracket 38 to secure the form sections together, such corner plate 54 being notched at its vertex to accommodate the retainer post 52 of the corner piece 25 at that corner. The assembled window form 12** is positioned on the casting pad at the desired location thereon and is secured to the pad by suitable means, not shown, so that the form is held against movement during casting of the wall.

As will be noted in FIG. 3, the outer member 28 of form section **12*d* has a plurality of recesses 55 formed into the casting surface 33, these recesses being provided so that hardware elements may be positioned at a desired location on the form for casting into the concrete. Preferably the recesses are shaped complementary to the portion of the particular hardware element which is to be left exposed when it is cast in place so that the hardware element will not wobble in the recess. Each recess has a permanent magnet 56 countersunk therein so that the magnet will engage and hold the hardware element securely in place when it is inserted into the recess. FIG. 3 illustrates one of the hinges 21 being inserted into one of the recesses, hinge 21 having suitable anchors 57 projecting therefrom for embedment in the wall. The shape of the positioning recesses 55**, the number thereof, and the specific location on the form sections will depend on the particular hardware that is to be used with the finished wall opening.

After the form has been assembled and secured to the casting pad, it is oiled, or otherwise treated to prevent sticking to the finished wall cast thereby. Appropriate hardware is inserted in the recesses and held in place by the magnets. Suitable reinforcement bars will, of course, have been positioned between the outer form 11 and window form 12. Concrete is then poured, up to the level of the tops of forms 11 and 12.

As soon as the concrete has set, the window form 12 may be removed. Screws 37 are loosened and the brackets 38 removed. The bridges 53 of the corner pieces are broken and the retaining posts 52 are removed. Any one of the form sections **12*a*–12*d* may then be pulled inwardly, as by use of handles 61 in FIG. 5, so that the outer member 28 is pulled out from under the shoulder 18 which has been formed in the concrete. It will be appreciated that the clearance between the end face 36 of inner member 35 and the central member 26 of the adjacent form section is no less than the thickness of the outer member 28. The form section is then moved straight up and removed. The other three form sections are similarly removed. The form sections may then be reused immediately in the casting of another while waiting for the just-cast wall to cure. The corner pieces 25** are pried out and discarded. During such removal of the form sections the magnets therein pull easily from the hardware associated therewith, leaving the hardware cast in place in the wall.

If desired, the corner posts could be reused. Indeed, they could be originally made without the retainer posts, i.e., as illustrated in FIG. 8. However, if so used, then it is necessary to tape the corner posts to the form sections **12*a*–12*d*** as the form is assembled so that the corner posts will hold in place for the pouring process. More time is required for the taping and tape marks will be imprinted into the finished window opening.

As is apparent from the foregoing, the present invention provides a form which can be easily assembled and used to cast a stepped opening having a downwardly facing shoulder and which can be readily removed from the cast concrete without destruction of the form members (other than the destruction of the inexpensive corner pieces).

Since the form sections **12*a*–12*d* are removable and reusable, fewer forms are required and it is thus economically feasible to make such forms with the precision that should be used so that the openings will have the exact dimensions and shapes desired and so that the hardware will be located in the cast opening at precisely the right places. Although the form sections may be made of wood, it is preferable to make them out of metal for greater durability and longer life. Although each of the form sections 12*a*–12*d* is shown as made up of three separate pieces, 26, 28 and 35, which are then secured together, the form sections could be made from a single piece of material, as long as the desired casting surfaces 27, 32 and 33** are provided and as long as the form sections have sufficient structural rigidity for the intended use. If the form sections are made of metal, it would be feasible to use a spot magnetization process to magnetize the form sections at the desired hardware locations so that separate magnets would not be needed.

Although the drawings illustrate only the formation of a single window opening, as many window openings may be cast in a wall as needed. Additionally, the form members described herein can be used to form door openings as well.

What is claimed is:

1. A form for casting a stepped opening in a concrete wall, said form comprising:

four elongated form sections, each having a first member extending the length of said form section, said first member having an outwardly facing casting surface along the upper length thereof, a second member integral with and extending along the first member below said casting surface, said second member having outwardly and downwardly extending casting surfaces thereon and extending the length thereof, said form sections being arranged as sides of a rectangle, a corner piece disposed at each corner of said form, each corner piece comprising a block having an L shape in horizontal cross-section, one leg of each of said blocks being abuttable against an end of the second member of one of the form sections at that corner and having outwardly and downwardly extending casting surfaces coplanar with the casting surfaces of the second member of said one form section at that corner, the other leg of each of said blocks being abuttable against an end of the second member of the other form section at that corner and having outwardly and downwardly extending casting surfaces coplanar with the casting surfaces of the second member of said other form section at that corner, each corner piece further comprising a post extending upwardly from the inner junction of the legs of the block thereof, the post of each corner piece having a first side facing outwardly and forming a casting surface, the post of each corner piece being abutted with the end of the first member of said one form section at that corner and with said first side of said post coplanar with the casting surface of said first member of said one form section at that corner, the post of each corner piece having a second side adjacent to said first side threof, said second side facing outwardly and forming a casting surface, the post of each corner piece being abutted with the end of the first member of said other form section at that corner and with said second side of said post coplanar with the casting surface of said first member of said other form section at that corner, the width of said first side of each of said posts being at least as great as the thickness of said first member of said other form section at that corner.

2. A form as set forth in claim 1 wherein the width of said second side of the post of each corner piece is at least as great as the thickness of the first member of said one form section at that corner.

3. A form as set forth in claim 1 wherein the ends of each of said second members of said form sections terminate a given distance short of the ends of said firt members thereof, and wherein the legs of each of said L-shaped blocks extend horizontally beyond the post associated therewith by said given distance.

4. A form as set forth in claim 1 wherein the post of a selected one of said corner pieces is rectangular-shaped in horizontal cross-section and further including a retainer member parallel to and detachably secured to said post of the selected corner piece at the vertical corner thereof diagonally across from the junction of the first and second sides of said post of the selected corner piece.

5. A form as set forth in claim 1 wherein said form sections each include a third member integral with and extending along the length of said first member on the inner side thereof, and wherein said third member of each of said form sections terminates short of the ends of the first member with which it is integral and at a distance therefrom which is at least as great as the thickness of the third member of the adjacent form section.

6. A form as set forth in claim 5 wherein the post of a selected one of said corner pieces is rectangular-shaped in horizontal cross-section and further including a retainer member parallel to and detachably secured to said post of the selected corner piece at the vertical corner thereof diagonally across from the junction of the first and second sides of said post of the selected corner piece.

7. A form as set forth in claim 1 wherein a selected one of said form sections further includes means thereon for positioning a hardware element at a predetermined location on one of said casting surfaces of said selected form section and further including a magnet mounted in said selected form section adjacent said positioning means.

8. A form as set forth in claim 7 wherein said positioning means comprises a recess formed into said selected form section from said casting surface thereof, said recess being shaped complementary to the shape of the portion of said hardware element which is to be left exposed after casting, and wherein said magnet is countersunk in said recess.

* * * * *